US008974633B2

(12) United States Patent
Samuelsson

(10) Patent No.: US 8,974,633 B2
(45) Date of Patent: Mar. 10, 2015

(54) SYSTEM AND METHOD FOR THE PUMPED FEED OF CHIPS TO A CONTINUOUS DIGESTER

(75) Inventor: Anders Samuelsson, Hammaro (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 13/505,809

(22) PCT Filed: Nov. 4, 2010

(86) PCT No.: PCT/SE2010/051207
§ 371 (c)(1),
(2), (4) Date: Jun. 29, 2012

(87) PCT Pub. No.: WO2011/056137
PCT Pub. Date: May 12, 2011

(65) Prior Publication Data

US 2012/0261084 A1 Oct. 18, 2012

(30) Foreign Application Priority Data

Nov. 6, 2009 (SE) ..... 0950839

(51) Int. Cl.
*D21C 7/06* (2006.01)
*D21C 7/08* (2006.01)
*F04D 7/04* (2006.01)
*F04D 29/68* (2006.01)

(52) U.S. Cl.
CPC .. *D21C 7/06* (2013.01); *D21C 7/08* (2013.01); *F04D 7/045* (2013.01); *F04D 29/688* (2013.01)
USPC ..... 162/17

(58) Field of Classification Search
CPC ..... D21C 3/26; D21C 7/06; D21C 7/08
USPC ..... 162/19, 52, 241, 246
See application file for complete search history.

(56) References Cited

U.S. PATENT DOCUMENTS

| | | | |
|---|---|---|---|
| 2,803,540 | A | 8/1957 | Durant |
| 2,876,098 | A | 3/1959 | Schandroch |
| 3,303,088 | A | 2/1967 | Gessner |
| 3,586,600 | A | 6/1971 | Rich et al. |

(Continued)

FOREIGN PATENT DOCUMENTS

| | | |
|---|---|---|
| DE | 157279 | 10/1985 |
| SE | 0800644 | 9/2009 |

(Continued)

OTHER PUBLICATIONS

Reed, Bryan and Taylor, Thomas—"Reducing Product Variation Through Improved Thick-Stock Mixing"—2001 TAPPI Journal Peer Reviewed Paper, Jul. 200/vol. 84: No. 7.

(Continued)

*Primary Examiner* — Anthony Calandra
(74) *Attorney, Agent, or Firm* — Rolf Fasth; Fasth Law Offices

(57) ABSTRACT

The system and method is for the pumping of finely divided cellulose material to a continuous digester. The system has a concentric arrangement of pipes. A fluid (Liq) is added to a chamber formed between the pipes to establish a cylindrical film of fluid around a rod-shaped flow of cellulose material before the inlet to the pump. It is possible in this way to reduce the pressure drop in the lines, reduce wear in the pump, and ensure a maximal pressure build up in the pump.

9 Claims, 3 Drawing Sheets

(56) References Cited

U.S. PATENT DOCUMENTS

| | | | | |
|---|---|---|---|---|
| 5,744,004 | A | 4/1998 | Ekholm et al. | |
| 5,753,075 | A | 5/1998 | Stromberg et al. | |
| 6,106,668 | A | 8/2000 | Stromberg et al. | |
| 6,277,243 | B1 | 8/2001 | Binder | |
| 6,325,890 | B1 | 12/2001 | Prough et al. | |
| 6,336,993 | B1 | 1/2002 | Stromberg | |
| 6,428,268 | B1 | 8/2002 | Addie | |
| 6,551,462 | B2 | 4/2003 | Prough et al. | |
| 6,841,042 | B2 * | 1/2005 | Stromberg et al. | 162/237 |
| 2003/0089470 | A1 | 5/2003 | Kettunen | |

FOREIGN PATENT DOCUMENTS

| | | |
|---|---|---|
| SE | 0800645 | 9/2009 |
| SE | 0800646 | 9/2009 |
| SE | 0800647 | 9/2009 |
| SE | 0800648 | 9/2009 |
| SE | WO2009116946 | 9/2009 |

OTHER PUBLICATIONS

Handbook of Pulp—Herbert Sixta, 2006—p. 381.
Handbook of Pulp—Herbert Sixta, 2006—p. 382.

* cited by examiner

SYSTEM AND METHOD FOR THE PUMPED FEED OF CHIPS TO A CONTINUOUS DIGESTER

PRIOR APPLICATION

This application is a U.S. national phase application that is based on and claims priority from International Application No. PCT/SE2010/051207, filed 4 Nov. 2010 that claims priority from Swedish Patent Application. Number 0950839-1, filed 6 Nov. 2009.

TECHNICAL AREA

The present invention concerns a feed system for a continuous digester in which chips are cooked for the production of cellulose pulp.

BACKGROUND AND SUMMARY OF THE INVENTION

High-pressure sluice feeders have been used in older conventional feed systems for continuous digesters for the pressurisation and transport of a chips slurry to the top of the digester.

In the *Handbook of Pulp* (Herbert Sixta, 2006) the principle of this type of feed using high-pressure sluice feeders is shown on Page 381. The major advantage of this type of feed is that the flow of chips does not need to pass through pumps, instead being transferred hydraulically. It is possible at the same time to maintain a high pressure in the transfer flow to and from the digester without losing pressure (experiencing pressure loss). The system, however, suffers from certain disadvantages in that the high-pressure feeder is subject to wear, and must be adjusted such that the leakage flow from the high-pressure circuit to the low-pressure circuit is minimised. A second disadvantage is that the temperature in the transfer must be kept low such that detonations caused by steam implosions do not occur in the transfer.

As early as 1957, U.S. Pat. No. 2,803,540 revealed a feed system for continuous chip digesters in which the chips are pumped from an impregnation vessel to a digester, in which the chips are cooked in a steam atmosphere. The cooking fluid is here added to the pump, in order to obtain a consistency of 10%, which can be pumped. This is a digester suggested for a small-scale production of 150-300 tonnes of pulp per day (see column 7, row 35).

Also U.S. Pat. No. 2,876,098 from 1959 reveals a feed system for a continuous chip digester without a high-pressure sluice feeder. The chips in this case are mixed to a slurry in a mixer before being pumped to the top of the digester by a pump. The pump arrangement is located under the digester, and the pump shaft is provided also with a turbine, through which the pressure is recovered from the pressurised black liquor in order to achieve the required pumping effect.

A feed system for a continuous chip digester without a high-pressure sluice feeder is revealed also in U.S. Pat. No. 3,303,088 from 1967, in which the chips are first pre-treated with steam in a pre-treatment vessel, and then formed to a slurry in a vessel, before the chips suspension is pumped to the top of the digester.

U.S. Pat. No. 3,586,600 from 1971 reveals a further feed system for a continuous digester principally intended to be used with fine wood material. Also in this case a high-pressure sluice feeder is not used, and the wood material is fed by a pump 26 through an upstream impregnation vessel to the top of the digester.

Corresponding pumping of fine wood material to the top of a continuous digester is revealed also in EP157279.

What is typical for these suggested digester plants from the late 1950s until the beginning of the 1970s is that they are intended for small digester plants with a limited capacity of around 100-300 tonnes of pulp per day.

A variant of the feed of chips to digesters is revealed in U.S. Pat. No. 5,744,004, in which the chips mixture is instead fed to the digester through several pumps arranged in series. In this case, pumps of the type known as DISCFLO™ are used. One disadvantage of this system is that this type of pump typically has a low pumping efficiency.

In the Handbook of Pulp mentioned earlier, a variant of the pumped feed of chips mixture known as TurboFeed™ is shown on Page 382. Three pumps are here arranged in series for the feed of the chips mixture to the digester. This type of feed has been patented in U.S. Pat. No. 5,753,075, U.S. Pat. No. 6,106,668, U.S. Pat. No. 6,325,890, U.S. Pat. No. 6,336,993 and U.S. Pat. No. 6,551,462; although in several cases U.S. Pat. No. 3,303,088, for example, has not been considered.

U.S. Pat. No. 5,753,075 concerns pumping from a steam pre-treatment vessel to a treatment vessel, and it is revealed in this case that an eductor-jet pump can be inserted before the first centrifugal pump, as is shown in FIG. 3, reference number 70.

U.S. Pat. No. 6,106,668 specifically concerns the addition of AQ/PS during pumping. U.S. Pat. No. 6,325,890 concerns at least two pumps arranged in series where these pumps are arranged at ground level.

U.S. Pat. No. 6,336,993 concerns a detailed solution in which not only are chemicals added in order to dissolve metals from the chips, but also is fluid withdrawn after each pump in order to reduce the metal content in the pumped chips.

U.S. Pat. No. 6,551,462 concerns in practice the same system as that already revealed in U.S. Pat. No. 3,303,088. Helical screw pumps or axial pumps of Hydrostal type are used in these systems, and this does not give the same head of pressure as centrifugal pumps of radial type. This may be one reason that it is necessary to install several pumps in series.

One major disadvantage of these systems that have several pumps arranged in series is limited availability. If one pump fails, the complete digester plant must stop production. With three pumps in series and a normal availability for each pump of 0.95, the total availability of the complete system will be only 0.86 ($0.95\times0.95\times0.95=0.86$). Systems with parallel pumped feed have therefore been developed, as is shown in, for example, the following patent applications: SE0800644, SE0800645, SE0800646, SE0800647 and SE0800648.

Pump feed, however, places heavy demands on the pumps and the wear is high, since the chips that are pumped have a blasting effect on the impeller vanes of the pump. It is desired also to reduce pressure drop in the inlet line to the pump as much as possible, such that the subsequent pump can establish maximal pressure.

A first purpose of the invention is to obtain an improved feed system for chips in which the optimal pressurisation can be established with a centrifugal pump. It is preferable that this centrifugal pump be a pump of diagonal or radial type.

Other purposes are to reduce pressure losses in the pump inlet and to reduce wear on the pump.

The purposes described above are achieved with a system and through a method of the present invention.

The system according to the invention is intended for the pumping of finely divided cellulose material to a continuous digester where the cellulose material is fed continuously to the top of the digester and is fed out from the bottom of the digester after delignification in the digester. The finely divided cellulose material is formed to a slurry in at least a first vessel or standpipe of a suitable type, from which the slurried cellulose material is fed out through a first outlet pipe that has a first internal diameter and that is arranged at the bottom of the first vessel. By arranging a second outlet pipe that has a second internal diameter concentrically around the first outlet pipe, a chamber is formed around the first outlet pipe. This chamber is closed by an end wall in the first vessel in the vicinity of the end, and it has an opening at the opposite end, and where the second outlet pipe is connected to an inlet of a pump. The chamber is further provided with inlets for the continuous addition of fluid to the chamber.

It is appropriate that the second outlet pipe overlap the first inlet pipe in the longitudinal direction along a stretch that defines the axial length of the chamber. This stretch is adapted such that a film of fluid can be established with a flow that is parallel to the flow of cellulose material.

In order to ensure the establishment of a continuous film of fluid, it is appropriate that the chamber be provided with a distributor for the addition of fluid at several positions around the periphery of the chamber. This distributor may be constituted by, for example, a number of inlets distributed across the periphery of the end wall. Alternatively, the inlets may be arranged on the outer surface of the second outlet pipe, close to the end wall of the chamber.

In order to establish a film of fluid that is maintained to the inlet of the pump, it is appropriate that the second outlet pipe be given a second internal diameter that is larger than the internal diameter of the first outlet pipe such that the chamber obtains a thickness between 1 and 20 centimeters. A lower thickness may be appropriate for small pipe dimensions and short stretches between the first vessel for the formation of the slurry of the cellulose material and the pump. In an application in which the internal diameter of the first outlet pipe has an internal diameter of 40 centimeters, the second outlet pipe may have an internal diameter of 42-45 centimeters.

Also the end wall of the chamber may, in an alternative embodiment, be fixed arranged at one of the pipes, for example the second outlet pipe, and make contact in a sealing manner with the second pipe, for example the outer surface of the first pipe, through a flexible seal, preferably a packing box seal. The design can absorb also a certain degree of obliqueness between the pipes through the use of such a point connection.

The method concerns the pumping of finely divided cellulose material to a continuous digester where the cellulose material is fed continuously to the top of the digester and is fed out from the bottom of the digester after delignification in the digester. The finely divided cellulose material is first formed to a slurry in at least a first vessel and is fed out in a rod-shaped flow of cellulose material towards a pump. The characteristic of the method is that fluid in the form of a cylindrical film of fluid is added around the rod-shaped flow of cellulose material before the rod-shaped flow of cellulose material reaches the inlet to the pump.

It has turned out to be the case, surprisingly, that the cellulose material that is fed out from an impregnation vessel retains its rod-shaped flow due to the reinforcing effects of the cellulose material. It is therefore possible to add fluid in the form of a cylindrical film LL of fluid around the rod-shaped flow PF of cellulose material before this flow reaches the inlet to the pump. The rod-shaped flow of cellulose material typically has a concentration, calculated as weight of wood added at the preceding slurrification vessel, in the range 60-100%, and during continuous operation in certain applications the concentration may be 98%.

It is preferable that the addition of fluid take place in such a manner that the thickness of the cylindrical film of fluid lies within the range 1-20 centimeters, and that this film of fluid is maintained surrounding the rod-shaped flow of cellulose material up to the inlet of the pump. A small degree of dispersal and mixing may take place at the interface between the film of fluid and the flow of cellulose material, but the film of fluid is maintained essentially intact along the inner surface of the pipe right up until the inlet to the pump.

A lubricating and protective film of fluid is in this way established that reduces the pressure drop in the lines leading to the pump. Wear in the pump is at the same time reduced, and a maximal pressure build up in the pump can be established. It is appropriate that a pressure be established in the film of fluid that is equal to or greater than the pressure in the flow of cellulose material.

DETAILED DESCRIPTION OF THE INVENTION

The concept "feed system for a continuous digester" will be used in the following detailed description. The term "feed system" is here used to denote a system that feeds chips from a treatment system for chips that are held at a low pressure, typically at an excess pressure of less than 2 bar and often at atmospheric pressure, to a digester in which the chips are held at a high pressure, typically 3-8 bar in the case in which a vapour-phase digester is used, and 5-20 bar in the case in which a hydraulic digester is used.

The term "continuous digester" is here used to denote either a vapour-phase digester or a hydraulic digester, even if the preferred embodiments are shown here as vapour-phase digesters, for purposes of example. The feed system may contain anything from one single pump up to at least 5-6 pumps in parallel.

It is possible with the principles of this solution to deliver feed systems for digesters with production capacities from 750 to 6,000 tonnes of pulp per day, using only a few pump sizes. This is very important since these pumps for the feed of chips mixtures at relatively high concentrations are very specific to their application, and where pumps that can deal with production capacities of 4,000-6,000 tonnes of pulp per day are very large and are manufactured only in very limited series containing a few pumps per year. The cost of these pumps then becomes a large part of the total cost of a digester plant.

The wear on these pumps will be relatively high, and it is desired to minimise the wear in these pumps in order to obtain a longer acceptable operating time.

Figure 1:
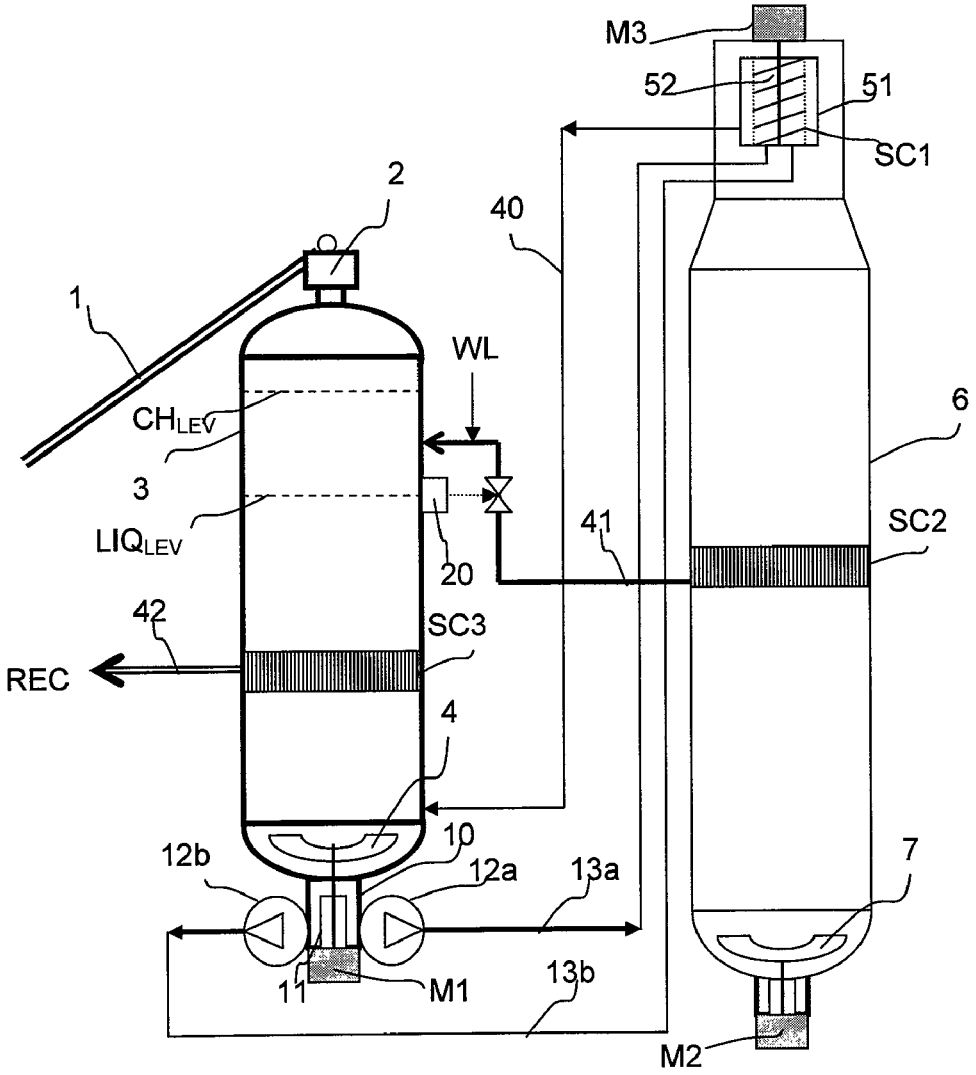
FIG. 1 shows a system solution for a feed system for digesters with top separators.

FIG. 1 shows a feed system with at least two pumps in parallel. The chips are fed by a belt transporter 1 to a chip bin 2 arranged above a treatment vessel 3 at atmospheric pressure. A lowest permissible fluid level $LIQ_{LEV}$ is established in this vessel through the addition of an alkali impregnation fluid, preferably cooking fluid (black liquor) that has been withdrawn at a strainer section SC2 in a subsequent digester 6, and with the possible addition of white liquor and/or other alkaline filtrates.

The chips are fed in with the conventional surveillance of the chips level $CH_{LEV}$, which is established above the fluid level $LIQ_{LEV}$.

The level of residual alkali in the withdrawn black liquor typically lies in the range 8-25 g/l. The amounts of black liquor and other alkaline fluids that are added to the treatment vessel 3 are regulated with a level sensor 20 that controls at least one of the flow valves in the lines 40/41. This alkaline impregnation fluid allows the wood acidity in the chips to be neutralised and to obtain impregnation with sulphide-rich ($HS^-$) fluid. Consumed impregnation fluid, with a residual alkali level of approximately 0-8 g/l, preferably 2-5 g/l, is withdrawn from the treatment vessel 3 through the withdrawal strainer SC3 and sent to the recovery process REC. Also white liquor WL can be added to the vessel 3 when necessary, as is shown, for example, in the figure at the line 41. The particular level of residual alkali depends on the type of wood used, conifer or deciduous, and the alkali profiles that are to be established in the cooking process.

In the case in which wood raw material is used that is easy to impregnate and neutralise, for example wood raw material in the form of chipped wood or wood chips of very small dimensions for which impregnation is rapid, the vessel 3 may, in the extreme case, be a simple chute with a diameter that essentially corresponds to that of the bucket-shaped outlet 10 at the bottom of the vessel. The retention time that is necessary in the vessel is determined by the fact the wood must become so well impregnated that it sinks in a free cooking fluid.

After the chips have been treated in the vessel 3 they are fed out from the bottom of the vessel, where also a conventional bottom scraper 4, driven by a motor M1, is arranged.

The chips are fed to the digester through at least one pump, where two pumps 12*a*, 12*b* in parallel are shown here, which pumps are connected to a bucket-shaped outlet tap 10 at the bottom of the vessel. The bucket-shaped outlet tap 10 has an upper inlet, a cylindrical cover and a bottom. The pumps are connected to the cylindrical cover.

In order to facilitate pumping of the chips mixture, the chips are formed to a slurry in a vessel 3 in order to form a chips suspension, in which vessel a supply of fluid is arranged through the lines 40/41 and controlled by a level regulator 20, which establishes a fluid level $LIQ_{LEV}$ in the vessel and above the pump level of at least 10 meters, preferably at least 15 meters, and even more preferably at least 20 meters. In this way, a high static pressure is established in the inlet to the pumps 12*a*, 12*b* such that one single pump can manage to pressurise and promote the chips suspension to the top of the digester without cavitation arising in the pump. The top of the digester is typically arranged at least 50 meters above the level of the pump, often 60-75 meters above the level of the pump, while at the same time a pressure of 3-10 bar is established in the top of the digester.

In order to facilitate further the output feed to the pumps, an agitator 11 is arranged in the bucket-shaped outlet tap. It is preferable that the agitator 11 be arranged on the same shaft as the bottom scraper, and driven by the motor M1. The agitator has at least two scraper arms that sweeps over the pump outlets arranged in the cover of the bucket-shaped outlet tap. It is preferable that dilution be arranged in the bucket-shaped outlet tap, which dilution may take place through a dilution outlet (not shown in the drawing) connected to the cover at its upper edge.

Figure 2:
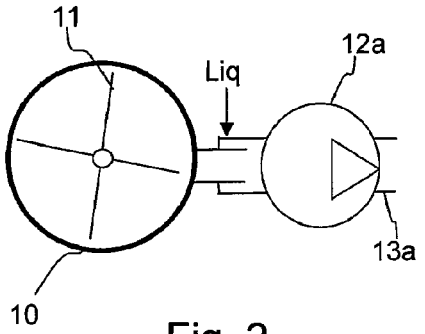
FIG. 2 shows schematically an embodiment of the invention used at a pump.

FIG. 2 shows schematically how a single pump 12*a* can be connected to the cylindrical cover of the outlet tap according to the invention, and how the agitator 11 can be provided with up to four scraper arms. The outlet from the bucket-shaped outlet tap 10 forms a first pipe that lies concentrically with a second surrounding pipe with a larger diameter, and in the gap between these pipes a fluid Liq is added.

Figure 3:
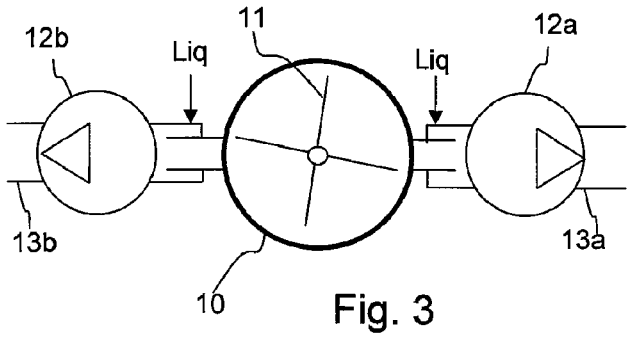
FIG. 3 shows schematically an embodiment of the invention used with parallel pumping.

FIG. 3 shows schematically how parallel pumping with two pumps 12*a*, 12*b* can be connected to the cylindrical cover of the outlet tap according to the invention.

Figure 4:
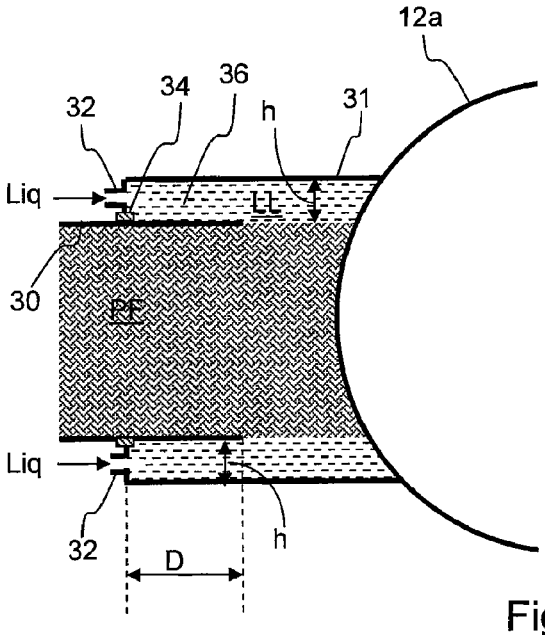
FIG. 4 shows a more detailed view of the invention.
Figure 5:
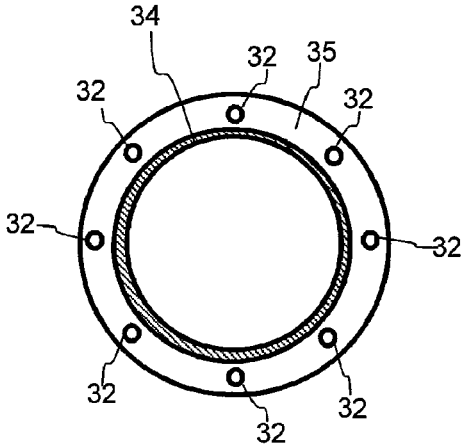
FIG. 5 shows FIG. 4 in a view seen from the left.

FIG. 4 shows in more detail how the connection between the cylindrical cover 10 of the outlet tap and the pump 12*a* are designed according to the invention. The first inner pipe 30 is connected at its left end to the cylindrical cover of the outlet tap and protrudes a certain distance D into a second surrounding pipe 31 that has a larger diameter. The inner pipe 30 is thus arranged concentrically within the surrounding pipe 31. The surrounding pipe 31 is connected at its left end to an end-wall plate 35, shown in FIG. 5, and arranged to form a seal with the first inner tube 30 through a suitable packing box seal 34 or bellows construction. Such a point connection between the pipes 30, 31 allows the connection to tolerate a certain obliqueness between the pipes. FIG. 4 shows in more detail how the connection between the cylindrical cover 10 of the outlet tap and the pump 12*a* are designed according to the present invention. The first inner pipe 30 is connected at its left end to the cylindrical cover of the outlet tap and protrudes a certain distance (D) into the second surrounding pipe 31 that has a larger diameter. The inner pipe 30 is thus arranged concentrically within the surrounding pipe 31. The surrounding pipe 31 is connected at its left end to an end-wall plate 35, shown in FIG. 5, and arranged to form a seal with the first inner tube 30 through a suitable packing box seal 34 or bellows construction. Such a point connection between the pipes 30, 31 allows the connection to tolerate a certain obliqueness between the pipes. The inner pipe 30, the outer pipe 31 and the end-wall plate 35 of the outer pipe 31 form a distribution chamber 36 therein that has an open end facing the pump 12*a*. A number of nozzles 32 are arranged in the end-wall plate 35, through which nozzles it is possible to add a fluid Liq to the space that is formed over the distance D between the pipes 30, 31. It is possible in this manner to establish a cylindrical film of fluid (LL) around the flow of pulp (PF), which film leaves the end of the inner pipe at a distance from the pump 12*a*.

The finely divided cellulose material has previously been formed to a slurry and is fed out in a rod-shaped flow PF of cellulose material towards the pump 12*a*.

Figure 6:
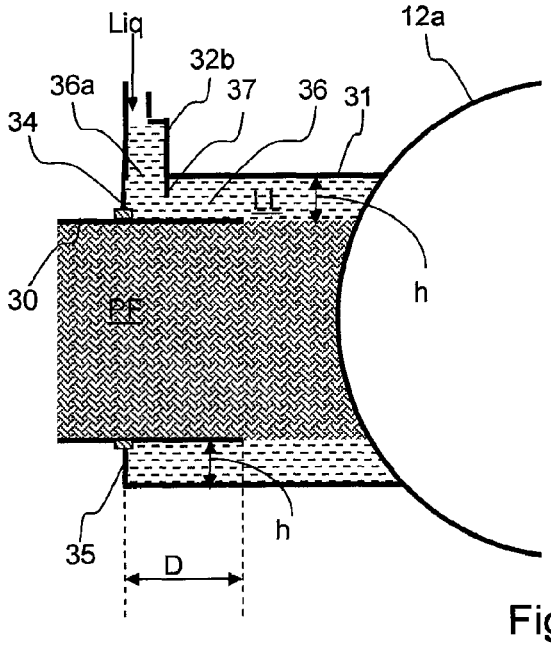
FIG. 6 shows an alternative to the embodiment shown in FIG. 4.
Figure 7:
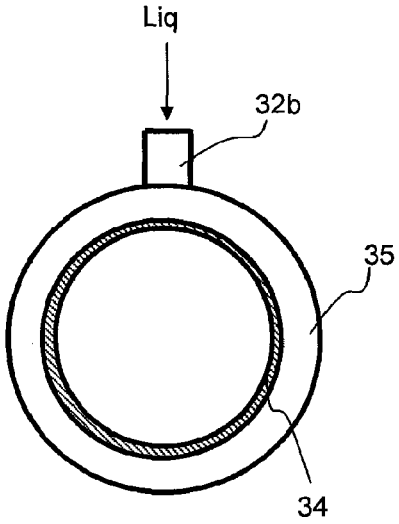
FIG. 7 shows FIG. 6 in a view seen from the left.

FIG. 6 shows an alternative to what has been shown in FIG. 4. The difference in this case is that a single addition line 32*b* for fluid is located on the second surrounding pipe 31, and where a first distribution chamber 36*a* is formed between the inner pipe 30 and the outer pipe 31 adjacent to the end-wall plate 35 attached to the outer end of the outer pipe 31. A throttle disk 37 can be located next to the addition line 32*b*, as is indicated in the drawing, in order to establish the same pressure drop around the periphery from a first part 36*a* of the distribution chamber 36 in a direction towards the inlet of the pump. This throttle disc 37 may have its greatest height adjacent to the position of the addition line 32*b* and then gradually reduce its height to become zero at the side opposite to the position of the addition line 32*b*, i.e. at the bottom of the drawing. It is possible also in this manner to establish a cylindrical film of fluid (LL) around the flow of pulp (PF), which film leaves the end of the inner pipe at a distance from the pump 12*a*. More particularly, the addition of fluid takes place in such a manner that a thickness (h) of the cylindrical film of fluid (LL) is within a range of 1-20 centimeters and in that the cylindrical film of fluid (LL) is maintained so that the cylindrical film surrounds the rod-shaped flow (PF), preferably, up to the inlet of the pump.

The finely divided cellulose material has previously been formed to a slurry and is fed out in a rod-shaped flow PF of cellulose material towards the pump 12*a*.

The invention is not limited to the embodiments described above: several variants are possible within the scope of the attached patent claims. It is possible, for example, to have more than one pump arranged in series with the first pump.

The invention claimed is:

1. A system for the pumping of finely divided cellulose material to a continuous digester comprising:

a first vessel containing a finely divided cellulose material formed into a slurry, the first vessel having a first end of a first outlet pipe arranged at a bottom of the first vessel, the first outlet pipe having a first internal diameter, a second outlet pipe having a second internal diameter concentrically surrounding the first outlet pipe, the second outlet pipe being cylindrical-shaped, the first outlet pipe, the second outlet pipe and an end-wall of the second outlet pipe having a chamber defined therebetween and around the first outlet pipe, the chamber terminating at the end-wall and being open at an opposite end of the chamber, and the pump having an inlet defined therein and the second outlet pipe being connected to the inlet of the pump, the second outlet pipe having one end attached to the inlet of the pump, the end-wall having inlets defined therein.

2. The system according to claim 1, wherein the second outlet pipe overlaps the first inlet pipe along a stretch (D), which defines an axial length of the chamber.

3. The system according to claim 2, wherein the chamber is provided with a distributor having adding means for adding a fluid at a number of positions around a periphery of the chamber.

4. The system according to claim 3, wherein the distributor has a number of inlets defined therein and distributed around a periphery of the end wall.

5. The system according to claim 1 wherein the second outlet pipe has an inner diameter that is greater than an outer diameter of the first outlet pipe.

6. The system according to claim 1 wherein an end wall is attached to one of the first outlet pipe or the second outlet pipe and is connected to the second outlet pipe in a manner that forms a seal through a flexible seal.

7. A method for the pumping of finely divided cellulose material to a digester comprising:

providing a vessel having a first outlet pipe having a first end arranged at a bottom of the vessel, the first outlet pipe having a first internal diameter, a second outlet pipe, having a second internal diameter, concentrically surrounding the first outlet pipe, the first outlet pipe, the second outlet pipe and an end-wall of the second outlet pipe having a chamber defined therebetween and around the first outlet pipe, a pump having a pump inlet connected to the second outlet pipe, forming a finely divided cellulose material to a slurry in the vessel, feeding out the cellulose material into the pump inlet via the first outlet pipe and the second outlet pipe, adding a fluid into the chamber to form a cylindrical film of fluid (LL) disposed in the chamber and inside an inner surface of the second outlet pipe, continuously feeding the cellulose material to a top of a digester, delignifying the cellulose material in the digester, and feeding out the cellulose material from a bottom of the digester.

8. The method according to claim 7, wherein the addition of fluid takes place in such a manner that a thickness (h) of the cylindrical film of fluid (LL) is within a range 1-20 centimeters and the cylindrical film surrounds a rod-shaped flow (PF).

9. The method according to claim 7, wherein the addition of fluid takes place in such a manner that the pressure established in the cylindrical film of fluid (LL) is equal to or greater than a pressure in a rod-shaped flow (PF) of the cellulose material flowing in the first outlet pipe and the second outlet pipe.

* * * * *